US005546060A

United States Patent [19]

Mrenna

[11] Patent Number: 5,546,060

[45] Date of Patent: Aug. 13, 1996

[54] SUPPORT PLATE FOR A CIRCUIT BREAKER

[75] Inventor: Stephen A. Mrenna, Beaver, Pa.

[73] Assignee: Eaton Corporation, Cleveland, Ohio

[21] Appl. No.: 362,402

[22] Filed: Dec. 22, 1994

[51] Int. Cl.[6] ..... H01H 75/12

[52] U.S. Cl. ..... 335/35; 335/202

[58] Field of Search ..... 335/23–25, 35, 335/167–176, 200

[56] References Cited

U.S. PATENT DOCUMENTS

| | | | |
|---|---|---|---|
| 2,798,918 | 7/1957 | Gelzheiser . | |
| 3,849,747 | 11/1974 | Mrenna et al. . | |
| 4,148,004 | 4/1979 | Gelzheiser . | |
| 4,616,200 | 10/1986 | Fixemer et al. | 335/172 |
| 5,008,645 | 4/1991 | Mrenna . | |
| 5,245,302 | 9/1993 | Brune et al. | 335/35 |
| 5,285,180 | 2/1994 | Rezac et al. | 335/202 |

*Primary Examiner*—Lincoln Donovan
*Attorney, Agent, or Firm*—Martin J. Moran

[57] ABSTRACT

A support plate for a circuit breaker has a longitudinal slot centrally located in the support plate, a free end with a tab for affixing an elongated bimetal of a trip assembly, a longitudinal edge opposite to the free end and terminating in proximity to a latch ledge of a cradle of an operating mechanism, opposed lobes each having a transverse edge, and an opening in each of the transverse edges. The support plate extends partially along a planar wall of a base of a housing for the circuit breaker. Molded pins in the base of the housing of the circuit breaker enter the openings in the transverse edges of the support plate for securing the support plate to the base. These molded pins extend outwardly to space the support plate away from the cradle of the operating mechanism. Bent over tabs are provided in one of the lobes for abutting a cover of the circuit breaker to maintain the fixed position of the support plate in the housing base.

10 Claims, 3 Drawing Sheets

SUPPORT PLATE FOR A CIRCUIT BREAKER

BACKGROUND OF THE INVENTION

1. Field of the Invention

This invention relates to circuit breakers, and more particularly to an improved design for a support plate and its mounting in a base of a housing of the circuit breaker.

2. Background Information

A common type of circuit breaker used to automatically interrupt abnormal currents in an electrical system incorporates a thermal trip device which responds to persistent low levels of overcurrent and a magnetic trip assembly which responds instantly to higher levels of overcurrent. In such circuit breakers the thermal trip device comprises a bimetal which flexes in response to the persistent low level overcurrent passed through it to unlatch a latchable operating mechanism. The latchable operating mechanism is spring operated to open electrical contacts which interrupt the current. Typically, the circuit breaker mechanism is mounted in a housing comprising a base section forming a cavity in which the circuit breaker mechanism is assembled, and a cover which is secured in place over the base to enclose the circuit breaker mechanism. Industry standards require that the thermal trip device in these circuit breakers be calibrated to trip the breaker in response to an overcurrent of a predetermined magnitude within a specified time interval. Commonly, this calibration of the thermal trip is performed "on the half shell." That is, the circuit breaker mechanism is assembled within the cavity of the breaker housing, and the thermal trip is calibrated before the mechanism is enclosed by the cover.

A common type of circuit breaker in which the thermal trip is calibrated in this manner is shown by way of example in U.S. Pat. No. 3,849,747. Such circuit breakers have been in use for many years and their design has been refined to provide an effective, reliable circuit breaker which can be easily and economically manufactured on a large scale. This type of circuit breaker has a metal support plate with an integral tab extending laterally from one end to which the bimetal of the thermal trip device is secured. The end of the support plate from which the tab extends is partially separated from the remainder of the support plate which is fixed in the housing by a transverse slot. The bimetal is calibrated by closing the circuit breaker and applying the prescribed overcurrent. A tool is inserted in the transverse slot in the support plate and when the specified time has expired, the tool is rotated to distort the free end of the support plate thereby adjusting the position of the support for the bimetal to cause the bimetal to trip the breaker. This calibration is presently carried out automatically, "on the half shell" by a machine. With the calibration set, the cover is installed and riveted in place. The circuit breaker is then tested to validate the calibration. Circuit breakers which do not pass the calibration test are reworked by inserting a hook through a slot in the end of the circuit breaker to engage the free end of the bimetal to attempt to bring it within tolerance. Such reworking is done manually, and being difficult to perform, only results in bringing about half of the rejected circuit breakers into tolerance.

It has been determined that the number of circuit breakers which fail the calibration test performed after the cover has been installed is in part due to minor changes in position and distortion of the mechanism resulting from misalignment of the housing pans causing the breaker to fall out of calibration. In order to overcome these effects, U.S. Pat. No. 4,148,004 proposes a circuit breaker of this type which is fully assembled with the cover riveted in place, and is then calibrated by a plug rotatably mounted in the wall of the housing and having a bifurcated stem which engages the tab on the support plate and the fixed end of the bimetal. A tool is inserted in apertures in the external face of the calibrating plug and rotated to set the calibration. Thus, the circuit breaker is calibrated after it has been fully assembled and the parts are fixed in their final position. However, it also allows one to change the calibration which is not in conformance with electrical codes in the United States.

U.S. Pat. No. 5,008,645 proposes a circuit breaker which overcomes the shortcomings of U.S. Pat. No. 4,148,004 which provides an indication that an attempt has been made to change the calibration once it has been set. In a preferred embodiment of the invention of U.S. Pat. No. 5,008,645, the circuit breaker assembly includes a support plate mounted in a cavity in the circuit breaker housing and extending along a planar wall of the housing. This support plate has a main portion fixed in the housing and a free end partially separated from the main portion by a transverse slot. The free end of the support plate supports the bimetal of the trip assembly. The calibration opening extends through the planar wall of the base of the housing and is aligned with the transverse slot in the support plate through which a tool is inserted to engage the transverse slot and rotate the free end of the support plate carrying the bimetal to calibrate the circuit breaker at the selected persistent current overload with the circuit breaker assembled and enclosed within the housing. The calibration opening of this embodiment of the invention is provided with tamper indicating seal means.

The support plate of this U.S. Pat. No. 5,008,645 has a length such that it substantially extends along the width of the planar wall of the base of the housing with the main portion being fixed in the housing by way of an opening which is keyed to and engaged by a projection of a cradle support post molded into the planar wall of the housing base. A further opening which is oval-shaped and located near the transverse slot fits snugly over a pin molded on the planar wall of the base, and cooperates with the opening of the main portion and its mounting on the cradle support post to firmly fix the position of the support plate within the housing base.

In this U.S. Pat. No. 5,008,645 the anchoring of the support plate onto the cradle support post to firmly fix the support plate into position was necessary in that the material for the base and the cover of the circuit breaker was subjected to changes in the temperature causing the circuit breaker components to expand or contract, including the support plate, which resulted in a disturbance of the calibration setting. Since the base and cover are now being made of a fiberglass material which is a better quality plastic material which does not contract and/or expand during the changes in temperature in the circuit breaker, it is not necessary to provide a support plate extending the length of the planar wall of the base for its mounting on the cradle support post. The support plate in a base made of fiberglass need only support the bimetal of a trip mechanism.

From the above, it can be appreciated that a support plate is necessary for calibration purposes. The demands of the electrical industry are for smaller and cheaper circuit breakers, and higher current interruption ratings. These criteria can be realized to some extent in view of the base and cover now being made of a glass polyester material such as fiberglass, which is dimensionally a more stable and a much stronger kind of plastic than previously available, and which does not contract and/or expand due to temperature fluctuations. Another factor which may help realize these criteria are smaller components for the circuit breaker assembly.

The circuit breaker which meets these criteria may still require a support plate for supporting a bimetal of a trip mechanism which is bent for calibration purposes.

There remains, therefore, a need for a circuit breaker which is cheaper to manufacture, which is smaller and more compact, and which has a higher interruption current rating than present-day circuit breakers.

More particularly, since the circuit breakers will be required to be smaller and thinner there is a need for such a circuit breaker to have a smaller and more shallow cavity for supporting the circuit breaker assembly than the cavity of present-day circuit breakers and, therefore, a need for an improved design for a support plate used for calibration purposes and for supporting the bimetal of the trip mechanism.

These and other needs are satisfied by the present invention.

SUMMARY OF THE INVENTION

The present invention provides an improved support plate which is smaller, which extends only about half the width dimension of the planar wall of a housing base, and which, therefore, contains substantially less material than prior art support plates.

Briefly, the support plate of the present invention is comprised of a planar surface with a longitudinal slot centrally located in its main portion in which a tool is inserted for calibration purposes. The support plate has a free end with a tab to which an elongated bimetal of a trip mechanism is attached and a longitudinal edge disposed opposite to the free end running substantially parallel to the longitudinal slot and terminating in close proximity to the latch ledge of a cradle of an operating mechanism for the circuit breaker assembly. The support plate further has spaced-apart lobes, each having a transverse edge with an opening along the transverse edge and located in close proximity to the longitudinal slot. Each opening fits snugly over a pin projection molded into a planar wall of a housing base to firmly fix the position of the support plate within the housing base. The pin projections are structured such that they space the cradle of the operating mechanism away from the support plate. The support plate of the invention is smaller and, therefore, has less metal material than prior art support plates.

It is, therefore, an object of the present invention to provide an improved design for a support plate for a circuit breaker which is less costly to manufacture, which contains less metal, and which is reduced in size compared to prior art support plates for circuit breakers.

It is a further object of the present invention to provide an improved designed for a support plate for a circuit breaker assembly which still provides for a calibration feature for the circuit breaker system.

It is still a further object of the present invention to provide a design for a support plate for a circuit breaker assembly which saves space in the cavity of the housing base and which may be used in a more compact circuit breaker mechanism.

These and other objects of the present invention will be more fully understood from the following description of the invention on reference to the drawings attached hereto.

DESCRIPTION OF THE PREFERRED EMBODIMENT

Figure 1:
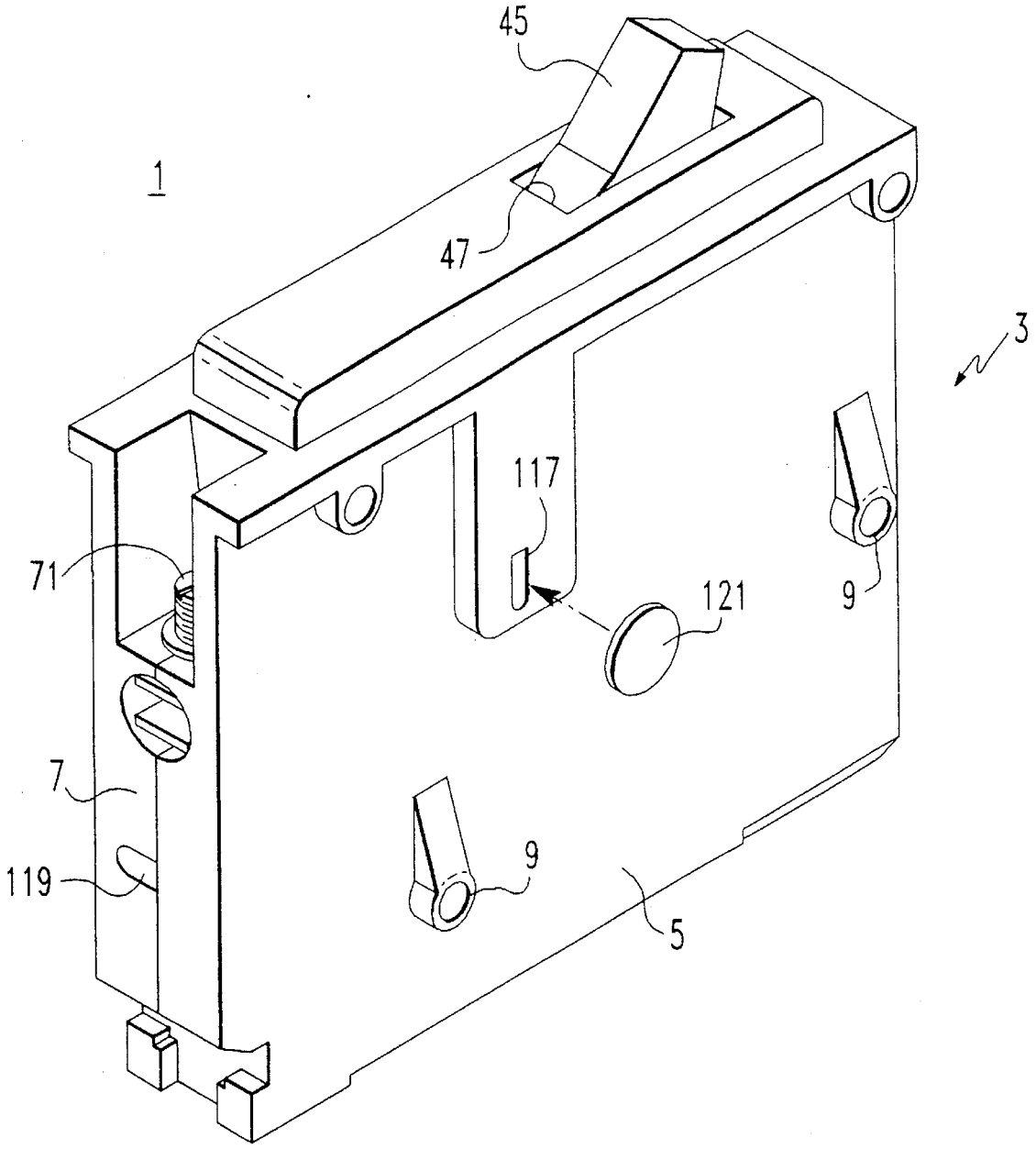
FIG. 1 is an isometric view of a circuit breaker employing the support plate of the present invention.

Referring first to FIG. 1, the circuit breaker 1 in which the present invention is employed comprises an electrically insulating housing 3 having a molded insulating base 5 and a molded insulating cover 7 which is secured to base 5 by rivets 9.

Figure 2:
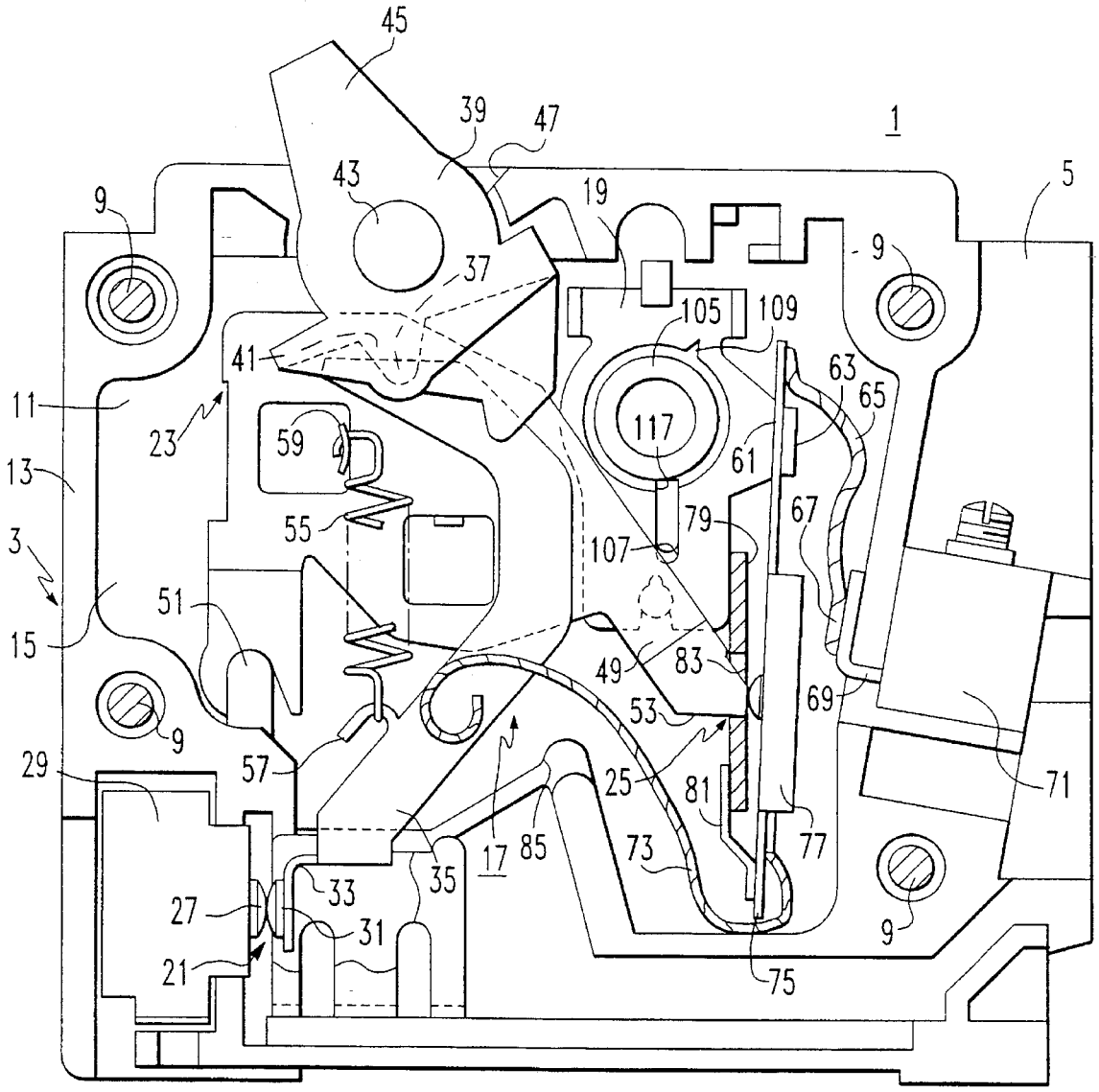
FIG. 2 is a side view of the circuit breaker of FIG. 1 with the cover removed and She circuit breaker mechanism shown in a closed position.

Referring to FIG. 2, base 5 has a planar wall 11 and edge walls 13 forming a cavity 15. A circuit breaker assembly, indicated generally at 17 in FIG. 2, is supported in the cavity 15 of the base 5 of housing 3. Circuit breaker assembly 17 includes a stationary support plate 19 of the present invention, a set of electrical contacts 21, a latchable operating mechanism 23, and a trip assembly 25.

The set of electrical contacts 21 includes a stationary contact 27 secured to a plug-in type line terminal 29, a movable contact 31 secured to a small flange 33 on one end of a flat metallic, generally C-shaped contact arm of switch arm 35 which forms part of the latchable operating mechanism 23. The contact arm 35 is provided at the upper end with a depression 37. A molded insulating operating member 39 has a molded part 41 which engages the depression 37 in the contact arm 35 to provide a driving connection between the operating member 39 and the contact arm 35. The operating member 39 is molded with a pair of pins 43 extending outwardly on opposite sides (only one shown) which fit into bearing openings (not shown) in the base 5 and the cover 7 of the housing 3 to support the operating member 39 for pivoted movement. The operating member 39 includes a handle part 45 which extends through an opening 47 on top of the housing 3 as shown in FIG. 1 to enable manual operation of the circuit breaker 1.

Referring again to FIG. 2, the latchable operating mechanism 23 also includes a cradle 49 supported at one end for pivoted movement on a molded post part 51 of the insulating housing base 5. The other end of the cradle 49 has a latch ledge 53 which is latched by the trip assembly 25 which will be described in detail. An over center tension spring 55 is connected, under tension, at one end to a projection 57 near the lower end of the contact arm 35, and at the upper end thereof to a bent over projection 59 on the cradle 49.

The trip assembly 25 comprises an elongated bimetal member 61 secured, in proximity to its upper end, to a bent over tab part 63 on the support plate 19. A flexible conductor 65 is secured at one end to the upper end of the bimetal member 61 and at the other end to a conductor 67 that extends through an opening 69 in the housing 3 and is part of a solderless terminal connector 71 that is externally accessible and supported in the housing 3 in a well-known manner. Another flexible conductor 73 is secured at one end to the free, lower end 75 of the bimetal member 61 and at the other end thereof to the contact arm 35 to electrically connect that contact arm 35 with the bimetal member 61.

The electrical circuit through the circuit breaker 1 extends from the line terminal 29, through the stationary contact 27, the movable contact 31, the contact arm 35, the flexible conductor 73, the bimetal member 61, the flexible conductor 65, the conductor 67, and the solderless terminal connector 71.

As more fully described in detail in U.S. Pat. No. 3,849,747 which is hereby incorporated by reference, the circuit breaker 1 may be manually operated to open and close the set of electrical contacts 21 by operation of the operating member 39 through the handle portion 45. The circuit breaker 1 is also operated automatically in response to overload conditions by the trip assembly 25.

The trip assembly 25 includes a thermal trip capability which responds to persistent low level overcurrents and a magnetic trip capability which responds instantaneously to higher overload currents. The trip assembly 25 includes the bimetal member 61, a magnetic yoke 77 and a magnetic armature 79. The magnetic yoke 77 is a generally U-shaped member secured to the bimetal member 61 at the bight portion of the magnetic yoke 77 with the legs thereof facing the armature 79. The magnetic armature 79 is secured to a supporting spring 81 that is in turn secured, at its lower end, near the free end 75 of the cantilevered bimetal member 61. Thus, the armature 79 is supported on the bimetal member 61 by the spring 81. The armature 79 has a window opening 83 through which the one end of the cradle 49 extends with the latch ledge 53 on the cradle engaging the edge of the window 83 to latch the latchable operating mechanism 23 in the latched position as shown in FIG. 2.

With the circuit breaker in the on position shown in FIG. 2, a persistent overload current of a predetermined value causes the bimetal member 61 to become heated and deflect to the fight to effect a time delayed thermal tripping operation. The armature 79, which is supported on the bimetal member 61 by means of the leaf spring 81, is carried to the right with the bimetal member 61 to release the cradle 49. When the cradle 49 is released, the spring 55 rotates the cradle clockwise on the post 51 until this motion is arrested by the engagement of the cradle 49 with a molded part 85 of the housing base 5. During this movement, the line of action of the spring 53 moves to the right of the point at which the contact arm 35 is pivoted on the operating member 39 to rotate the contact arm 35 counterclockwise to snap the set of electrical contacts 21 open. In addition, the operating member 39 is rotated to position the handle 45 to a position intermediate of the "on" and "off" positions to provide a visual indication that the circuit breaker 1 has tripped open.

The tripped position of the various parts as discussed in the preceding paragraph is shown and discussed in U.S. Pat. No. 5,008,645, which is hereby incorporated by reference. The circuit breaker is reset by moving the handle 45 to the full clockwise off position (not shown) to relatch the cradle 49 and is then rotated counterclockwise to the on position shown in FIG. 2 which moves the upper end of the contact arm 35 to the right of the line of action of the spring 55 to snap the contacts to the closed position.

The circuit breaker 1 is magnetically tripped automatically and instantaneously in response to overload currents above a second predetermined value higher than the predetermined value for the thermal trip. Flow of overload current above this higher predetermined value through the bimetal member 61 induces magnetic flux around the bimetal. This flux is concentrated by the magnetic yoke 77 toward the armature 79. Overload current above the second predetermined value generates a magnetic force of such a strength that the armature 79 is attracted toward the magnetic yoke 77 resulting in the flexing of the spring 81 permitting the armature 79 to move to the right to release the cradle 49 and trip the circuit breaker open in the same manner as described with regard to the thermal tripping operation. Following a magnetic trip operation, the circuit breaker is reset and relatched in the same manner as described above.

The bimetal member 61 is designed to respond to persistent low level overcurrents inversely as a function of time. That is, the greater the magnitude of the current the shorter the time for the thermal trip. While the construction of the bimetal unit is such that it conforms to the inverse current characteristic reliably, the circuit breaker 1 must be calibrated to assure that this inverse current response characteristic produces a trip at code specified conditions. Typically, the circuit breaker 1 is calibrated so that at 250% of rated current it trips within 15 to 25 seconds. The circuit breaker 1 is calibrated by applying the specified overcurrent to the circuit breaker, and then adjusting the circuit breaker mechanism so that it trips within the specified time period. Thus, for example, in the case of a 20 amp circuit breaker, 50 amperes are applied to the circuit breaker in the closed position, and the circuit breaker mechanism is adjusted so that a trip occurs within 15 to 25 seconds.

Figure 3:
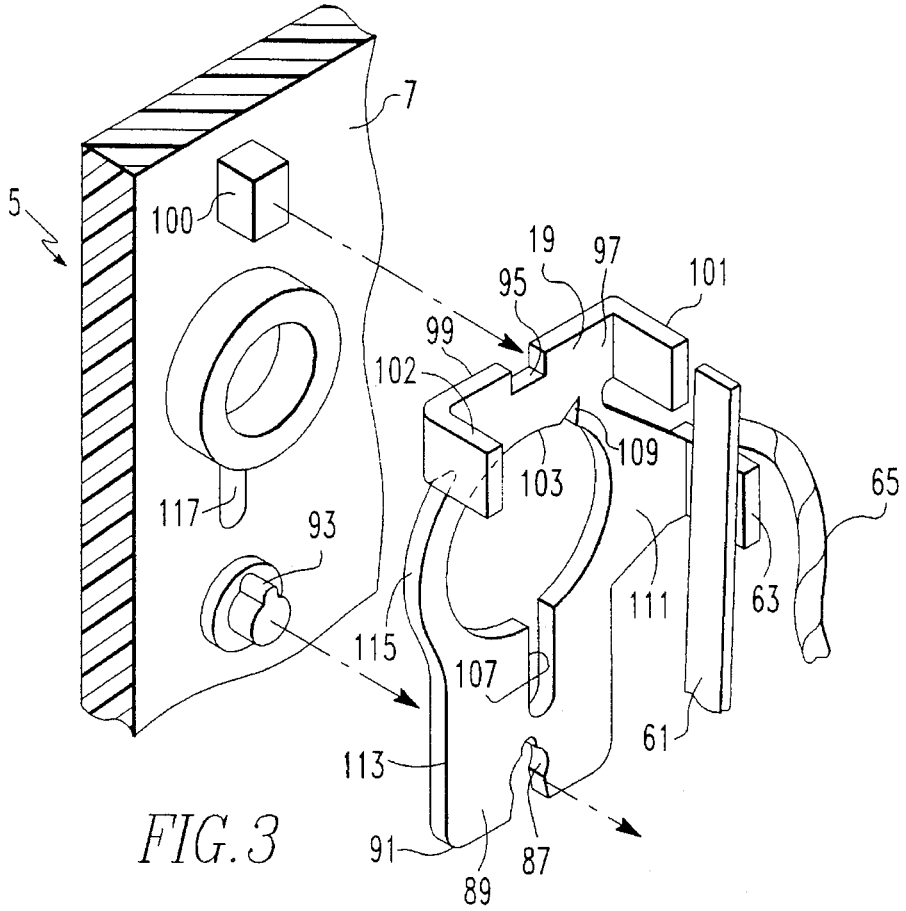
FIG. 3 is an isometric view of the support plate of the present invention and its mounting pins molded onto a planar wall of the housing base of the circuit breaker of FIG. 1.
Figure 4:
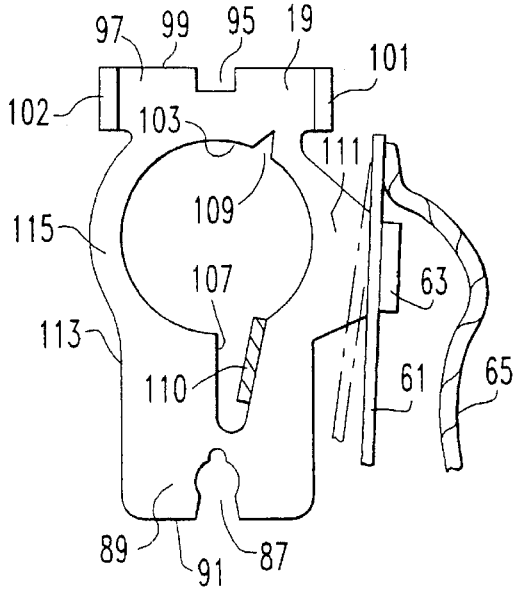
FIG. 4 is a side view of the support plate of FIG. 3 showing in phantom a calibration adjustment for the bimetal of a trip mechanism of the circuit breaker.

Calibration of the circuit breaker 1 is effected through adjustment of the support plate 19 which is shown in more detail in FIGS. 3 and 4.

The support plate 19 of the present invention has a key-shaped opening 87 in a lobe 89 formed along a transverse edge 91 and engages a key-shaped pin 93 molded into the planar wall 11 of housing base 5. A rectangular opening 95 is spaced opposite from key-shaped opening 87 in lobe 97 and is formed along a transverse edge 99 and engages a rectangular shaped pin 100 also molded into the planar wall 11 of housing base 5. Openings 87 and 95 fit snugly over pins 93 and 100, respectively, to firmly fix the position of support plate 19 within housing base 5. Bent over tabs 101 and 102 in upper lobe 97 of support plate 19 butt against the cover 7 of housing 3 to further maintain the fixed position of support plate 19 when the circuit breaker 1 is assembled.

Both pins 93 and 100 are formed in planar wall 11 of housing base 5 such that when support plate 19 is fixed thereto, pins 93 and 100 extend beyond support plate 19 to space cradle 49 away from support plate 19 when breaker assembly 17 is assembled in base 5 so that cradle 49, which generally is made of a metal material, is spaced away from support plate 19 which, preferably, is made of a metal material such as steel. As is apparent, this spacing of metal support plate 19 and metal cradle 49 is necessary in order to eliminate current travelling through plate 19 to cradle 49 and tension spring 55, thereby bypassing bimetal member 61.

A large aperture 103 approximately centrally located in support plate 19 accommodates an annular flange 105, shown in FIGS. 2 and 3, which is molded on planar wall 11 of base 5 through which a cam may extend when the circuit breaker 1 is coupled with a similar circuit breaker to form a two-pole breaker in which simultaneous tripping of both poles is affected by the cam extending through flange 105. For a two pole operation, the portion of planar wall 11 aligned with flange 105 is knocked out to accommodate the cam, in a manner well-known in the art.

Aperture 103 and an intersecting slot 107 extend longitudinally and centrally through support plate 19 from lobe 97 to lobe 89 as shown in FIG. 3. As is apparent, this spacing of metal support plate 19 and metal cradle 49 is necessary as to eliminate the possibility of current travelling through plate 19 to cradle 49 and tension spring 55 thereby bypassing bimetal member 61. A notch 109 in the peripheral edge of aperture 103 helps weaken the connection of the free end 111 from the remainder of support plate 19. Tab 63 to which bimetal 61 is secured extends laterally from the free end portion 111 of support plate 19 as shown in FIGS. 3 and 4.

Opposite to free end 111 of support plate 19 and running generally parallel to aperture 103 and intersecting slot 107 is a longitudinal edge 113 having portions which aid to form lobes 89 and 97 and an arcuate portion 115 adjacent to aperture 103 of support plate 19.

As shown particularly in FIG. 2, longitudinal edge 113 of support plate 19 near lower lobe 89 terminates toward the latch ledge 53 of cradle 49 when both support plate 19 and cradle 49 are assembled in cavity 15 of base 5.

Referring again to FIGS. 3 and 4, rectangular opening 95 is slightly wider than the width of rectangular pin 100 so that the free end 111 of plate 19 can freely be bent during the calibration process. Whereas, opening 87 is slightly smaller than pin 93 for a press fit.

The calibration process for the circuit breaker 1 of FIGS. 1 and 2 may be similar to that disclosed in the aforementioned U.S. Pat. No. 5,008,645 and may be performed prior to cover 7 being placed over base 5 to enclose cavity 15, or after cover 7 has been placed over base 5 to enclose cavity 15. If cover 7 has already been placed over base 5 to enclose cavity 15, an opening 117 shown only in FIG. 1 may be provided in the planar wall 11 of housing base 5 in alignment with slot 107 in support plate 19.

A tool 110 shown in FIG. 4 is inserted through opening 117 into slot 107, and is rotated to distort the free end 111 of the support plate 19 thereby rotating tab 63 carrying the bimetal 61 and forcing the breaker to trip. As shown in FIG. 4, the distortion causes bimetal 61 to rotate from the phantom position to the full line position. This calibration is performed automatically by a machine which applies current to the terminals, inserts the tool into opening 117 and slot 107, and rotates the tool to force the breaker to trip upon expiration of the prescribed time.

If cover 7 has not been placed over base 5 to enclose cavity 15, then the machine inserts the tool into slot 107 of support plate 19 and rotates the tool to force the breaker to trip. Once the cover 7 is placed over base 5 and is secured in place by rivets 9, the circuit breaker is tested by again applying the calibrating current and observing whether the breaker trips at the prescribed time within specified tolerances in a manner similar to that described in the aforementioned U.S. Pat. No. 5,008,645. In referring to FIG. 1, manual calibration can be done by inserting a hook through opening 119 of FIG. 1 to engage the free end of the bimetal and either push or pull the bimetal in an attempt to bring the thermal trip within calibration limits and/or a tamper indicating seal 121 may be installed over opening 117 to provide a visual indication of any attempt to change the calibration setting as taught in the aforesaid U.S. Pat. No. 5,008,645.

From the above, it can be appreciated that the present invention provides a support plate which needs to extend only partially along the planar wall 11 of housing base 5 for calibration purposes, whereas the support plate of the prior art needs to extend fully along the planar wall of the housing so that the plate is fixedly secured for calibration purposes for the circuit breaker.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A circuit interrupter, comprising:

an electrically insulating housing including a base having a planar wall and edge walls forming a cavity and a cover enclosing said cavity, a circuit breaker assembly within said cavity in said housing and comprising electrical contacts movable between open and closed positions, an operating mechanism for said circuit breaker assembly including a cradle with a latch ledge latchable in a latched position and operating when unlatched to automatically move said electrical contacts to said open position, a trip assembly including an elongated bimetal which latches said latch ledge of said cradle in the latched position and which flexes to unlatch said latch ledge of said cradle in response to predetermined persistent current overload conditions, and a support plate mounted in said cavity along said planar wall of said base of said housing, and having a free end with tab means to which said elongated bimetal of said trip assembly is attached and longitudinal slot means centrally located in said support plate through which a tool is inserted to rotate said free end of said support plate and said bimetal therewith to calibrate the unlatching of said latch ledge of said cradle at said selected persistent current overload conditions, said support plate partially extending along said planar wall of said base, having a longitudinal edge disposed opposite to said free end of said support plate, and terminating in proximity to said latch ledge of said cradle of said operating mechanism and including opening means in close proximity to said longitudinal slot means of said support plate, said planar wall of said base of said housing including molded pin means in said planar wall for receiving said opening means of said support plate for obtaining a fixed position of said support plate to said planar wall in said cavity of said base.

2. A circuit interrupter of claim 1, wherein said support plate has opposed transverse edges and wherein said opening means of said support plate includes at least a first opening disposed in one of said opposed transverse edges of said support plate and a second opening disposed in another of said opposed transverse edges of said support plate.

3. A circuit interrupter of claim 2, wherein said support plate further comprises opposed lobe means each located on opposite sides of said longitudinal slot means and terminating in one of said opposed transverse edges thereof.

4. A circuit interrupter of claim 3, wherein said support plate further comprises bent over tab means located on at least one of said opposed lobe means for abutting said cover to maintain said fixed position of said support plate to said planar wall.

5. A circuit interrupter of claim 1, wherein said molded pin means are structured to space said cradle of said operating mechanism away from said support plate.

6. A support plate for a circuit interrupter having a trip assembly with an elongated bimetal, and an operating mechanism including a cradle with a latch ledge, said support plate, comprising:

a free end with a tab means to which said elongated bimetal of said trip assembly is attached, longitudinal slot means centrally located in said support plate through which a tool is inserted to rotate said free end of said support plate and said bimetal therewith to calibrate the unlatching of said latch ledge of said cradle at said selected persistent current overload conditions, a longitudinal edge disposed opposite to said free end and terminating near said latch ledge of said cradle of said operating mechanism, and opening means in close proximity to said longitudinal slot means of said support plate for receiving pin means of said circuit interrupter for obtaining a fixed position of said support plate in said circuit interrupter.

7. A support plate of claim 6, further comprising opposed transverse edges, and wherein said opening means includes at least a first opening disposed in one of said opposed transverse edges and a second opening disposed in another of said opposed transverse edges of said support plate.

8. A support plate of claim 7, wherein said first opening has a key-shaped configuration and said second opening has a rectangular configuration, and wherein said molded pin means of said circuit interrupter have configurations corresponding to said first opening and said second opening.

9. A support plate of claim 7, further comprising:

opposed lobe means, each located on opposite sides of said longitudinal slot means and terminating in one of said opposed transverse edges thereof.

10. A support plate of claim 9, said support plate further comprising:

bent over tab means located on at least one of said opposed lobe means for maintaining said fixed position of said support plate in said circuit interrupter.

* * * * *